US007832378B2

(12) United States Patent
Bolz

(10) Patent No.: US 7,832,378 B2
(45) Date of Patent: Nov. 16, 2010

(54) DEVICE FOR SWITCHING INDUCTIVE FUEL INJECTION VALVES

(75) Inventor: Stephan Bolz, Pfatter (DE)

(73) Assignee: Continental Automotive GmbH, Hannover (DE)

( * ) Notice: Subject to any disclaimer, the term of this patent is extended or adjusted under 35 U.S.C. 154(b) by 203 days.

(21) Appl. No.: 12/162,017

(22) PCT Filed: Jan. 23, 2007

(86) PCT No.: PCT/EP2007/050643

§ 371 (c)(1),
(2), (4) Date: Jul. 24, 2008

(87) PCT Pub. No.: WO2007/085591

PCT Pub. Date: Aug. 2, 2007

(65) Prior Publication Data

US 2009/0126692 A1 May 21, 2009

(30) Foreign Application Priority Data

Jan. 24, 2006 (DE) ..... 10 2006 003 388
May 31, 2006 (DE) ..... 10 2006 025 360

(51) Int. Cl.
*F02M 51/00* (2006.01)
*F02M 51/06* (2006.01)

(52) U.S. Cl. ..... 123/490

(58) Field of Classification Search ..... 123/490, 123/499, 472, 478; 239/585.1; 251/129.15, 251/129; 361/152, 154, 155, 156, 187, 194, 361/205, 139, 153
See application file for complete search history.

(56) References Cited

U.S. PATENT DOCUMENTS 4,040,397 A * 8/1977 Leichle ..... 123/490
4,377,144 A * 3/1983 Takahashi ..... 123/490
5,748,433 A 5/1998 Schrey et al.

FOREIGN PATENT DOCUMENTS

DE 4016816 A1 11/1991
DE 19526681 A1 1/1997
DE 19921938 A1 12/1999
DE 10018175 A1 10/2001
EP 1146217 A2 10/2001

* cited by examiner

*Primary Examiner*—Mahmoud Gimie
(74) *Attorney, Agent, or Firm*—Laurence A. Greenberg; Werner H. Stemer; Ralph E. Locher

(57) ABSTRACT

Disclosed are a method and a device for more rapidly switching inductive fuel injection valves. According to the invention, the magnetic retaining forces generated by remanence in a bistable valve comprising an opening and closing coil or by eddy currents in a standard valve comprising an opening coil and a closing spring are eliminated with the aid of a negative current that flows through the coil in a direction running counter to the direction of the operating current. Additionally, the magnetic yoke and armature that are used are made of materials having different conductivities in order to be able to close the valve even more quickly.

14 Claims, 9 Drawing Sheets

DEVICE FOR SWITCHING INDUCTIVE FUEL INJECTION VALVES

BACKGROUND OF THE INVENTION

Field of the Invention

The invention relates to a device for switching inductive fuel injection valves.

Tighter statutory emission standards and the obligation to achieve increasingly efficient utilization of fuel have been critical factors over the last several years in advancing the introduction of high-pressure direct injection systems for diesel and gasoline engines, since by this means the quality of the fuel mixture generation is significantly improved.

Features of said systems are very high fuel injection pressures of up to 2000 bar and more (diesel) and in excess of 100 bar (gasoline), as well as the metering of the fuel in a plurality of partial injections per injection cycle.

As a result of this adaptation of the fuel metering to the dynamics of the combustion cycle, a host of functional improvements can be achieved:

- in the gasoline engine: greater efficiency, lower raw emissions;
- in the diesel engine: fewer engine noises (knocking), reduction in soot particles, less NOx generation, better cold start performance.

In many diesel engines fuel is still injected at periodic intervals even during the exhaust stroke in order for instance to achieve the regeneration of a particle filter in the exhaust system by burning off the soot particles.

The multiplicity of said functions that are possible using modern direct-injection systems has subsequently resulted in a massive tightening of the requirements in terms of the precision and dynamics of the injection valves. Thus, for example, valve switching times of 100 to 500 μs are now required in order to be able to inject even minimum fuel quantities down to a few μg with high precision and high timing accuracy at the high system pressures.

This has finally enabled piezoelectric technology to make the breakthrough, since this technology permits a much faster and more precise valve actuation compared to traditional solenoid technology. It has meanwhile become standard for diesel engines in passenger cars.

Since the piezoelectric ceramic used here reacts spontaneously to a change in control voltage with a change in the volume of the injected fuel quantity, a very fast, almost delay-free actuation of the injection valves is possible. In contrast thereto, in the case of the conventional solenoid valve a current flow must first be built up in the inductance-susceptible exciter winding, which current flow can then actuate the valve, though only after reaching a specific current value.

Admittedly, however, the advantages of piezoelectric technology for high-pressure injection valves are associated with considerable costs, so that there is an urgent need to continue using solenoid injection valves as well for less demanding high-pressure direct-injection systems.

A typical example of this are large-volume, slow-running diesel truck engines, such as, say, 6-cylinder engines with a cylinder volume of 9 liters and maximum operating speeds of about 1800 rpm. In addition to the low speed, the requirements in terms of minimum injection quantities are also reduced owing to the large engine displacement. The number of injection pulses per injection cycle is also lower, since e.g. a pre-injection to reduce the typical diesel "rattling" due to the already very high running noise of the truck engine can be dispensed with.

Studies have meanwhile shown that solenoid injection valves, while suitable in principle for such applications, still require some further developments. Thus, in order for standard solenoid valves which have a coil (winding) for magnetically opening and a spring for closing the valve to be made suitable for use in direct-injection systems, the closing delay must be reduced.

The main obstacle during the closing of a standard solenoid valve of this kind are the eddy currents in the magnetic material of the valve which decay only slowly after the actuation current has been turned off and prevent a fast closing of the valve. This behavior defines the minimum valve opening time and consequently increases the smallest possible fuel injection quantity.

In the case of bistable injection valves having two windings and fixing of the valve in the respective end position by means of remanence forces, a reduction is required both in the turn-on time for opening the valve and in the turn-off time for closing the valve.

FIG. 1 shows a schematic of a known circuit arrangement for operating a coil of a fuel injection valve using the PWM (Pulse Width Modulation) mode of operation. There, one terminal of the coil L1 is connected by means of a first switching transistor T1 to the positive pole V+ of a supply voltage source V and the other terminal is connected by means of a second switching transistor T2 to reference potential GND. The source terminal of the first switching transistor T1 is connected to one terminal of the coil L1, and its drain terminal to the positive pole V+. The source terminal of the second switching transistor T2 is connected to reference potential GND and its drain terminal to the other terminal of the coil L1. In addition, a freewheeling diode D1 is arranged to conduct current from reference potential GND to one terminal of the coil L1 and a recuperation diode D2 is arranged to conduct current from the other terminal of the coil L1 to the positive pole V+ of the supply voltage source.

The circuit according to FIG. 1 operates as follows: prior to the start of a turn-on operation let both switching transistors T1, T2 be non-conducting. At turn-on start (opening signal EO, rising edge) both switching transistors T1, T2 are switched to the current-conducting state. This causes the supply voltage V, where V=48V for example, to be applied to the coil inductance. A current flows through the coil L1, which current quickly increases.

Upon reaching a predefined upper current setpoint value at which the valve opens, switching transistor T1 is switched to non-conducting by means of the PWM unit PWM and the coil current now flows through the coil L1 via the freewheeling diode D1 and switching transistor T2, slowly decreasing in the process. If the current now reaches a lower predefined setpoint value, switching transistor T1 is again switched to conducting, whereupon the coil current increases once again.

By repeated switching of switching transistor T1 between the conducting and non-conducting state the coil current can thus be held at an approximately constant value during the turn-on time of the valve. At the end of the turn-on time (falling edge of the opening signal EO) both switching transistors T1 and T2 (in the case of a standard valve with closing spring) are switched to non-conducting simultaneously, whereupon the coil L1 discharges via the freewheeling diode D1 and the recuperation diode D2 into the supply voltage source V and the valve closes.

FIG. 2 shows, as described above, in the upper track the voltage profile and in the lower track the current profile in the opening coil L1 during the opening time of a standard fuel injection valve.

FIG. 3 shows the principle of a bistable fuel injection valve. The valve needle 1 is movably mounted in a housing 4 and is shown in the "OPEN" position. It butts against the left-hand magnetic yoke 2. The left-hand magnetic yoke 2 encloses the opening coil A-B (rectangles A and B with beveled edge). The left-hand magnetic yoke has been magnetized by means of a preceding actuation current in the opening coil A-B so that it now, when the current decays, holds the valve needle 1 in the "OPEN" position.

In this position the path is free for the highly pressurized fuel to pass from the inlet a (in the direction of the arrow) to the outlets b and c and on to the valve nozzles (not shown), which are thereby opened. In the following description the term "fuel" can also refer to a "hydraulic medium", in which case instead of a fuel circuit a hydraulic circuit can be provided by means of which a fuel injection valve is controlled by means of hydraulic pressure transmission.

In order to close the valve an actuation current is now conducted through the closing coil C-D such that the valve needle 1 moves to the right-hand magnetic yoke 3. After the closing current is switched off, the valve needle 1 is held in the "CLOSED" position by the magnetization of the right-hand magnetic yoke 3.

This causes the path from the inlet a to the outlets b and c to be closed. At the same time the outlets b and c are connected to the return lines r which are implemented as circular lines and reduce the fuel pressure between the outlets b, c and the valve nozzles (not shown), as a result of which the valve is closed.

Since a bistable valve has two coils, namely an opening and a closing coil, the circuit arrangement according to FIG. 1 has to be provided twice per valve: once for driving the opening coil A-B (L1 in FIG. 1) and once for driving the closing coil C-D.

DE 100 18 175 A1 discloses a circuit arrangement for operating a lift armature actuator for a charge cycle valve, wherein at the end of the actuation cycle a current is sent through the coil in the opposite direction to the actuation current in order to initiate a faster changeover of the switching state.

Methods of this kind are also known for example from DE 199 21 938 A1, DE 195 26 681 A1 and DE 40 16 816 A1.

BRIEF SUMMARY OF THE INVENTION

The object of the invention is to provide an improved device for faster switching of inductive fuel injection valves which

- reduces the opening and closing delay in the case of bistable valves, and
- reduces the closing delay in the case of standard solenoid valves (with closing spring).

This object is achieved according to the invention by a device according to the features of claim 1 or 6.

Advantageous developments of the invention may be derived from the dependent claims.

As is well-known, the valve switching times are reduced in the case of a bistable valve when the magnetic holding forces generated during the activation of a coil are eliminated by selective quenching of the remanence of the other coil, and in the case of a standard valve (with closing spring) when the magnetic holding forces—induced by the decaying eddy currents—are eliminated during the deactivation of the coil.

In both cases it is necessary for this purpose to impress a negative current pulse into the respective coil, whereby the current level and time characteristic of said current pulse must correspond as exactly as possible to the magnetic requirements of the valve.

Exemplary embodiments according to the invention are explained in more detail below with reference to a schematic drawing, in which:

DESCRIPTION OF THE INVENTION

Figure 1:
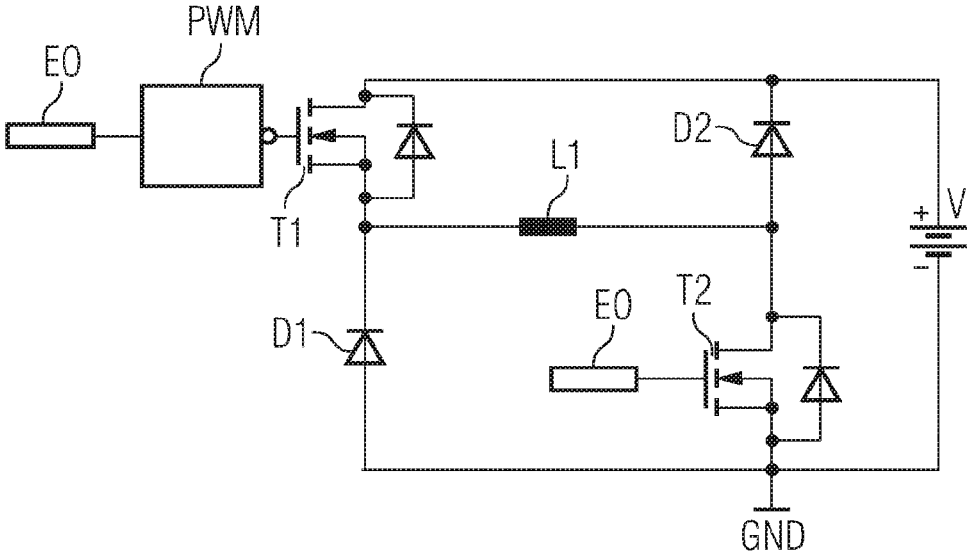
FIG. 1: is a schematic of a known circuit arrangement for PWM operation of an inductive fuel injection valve.
Figure 4:
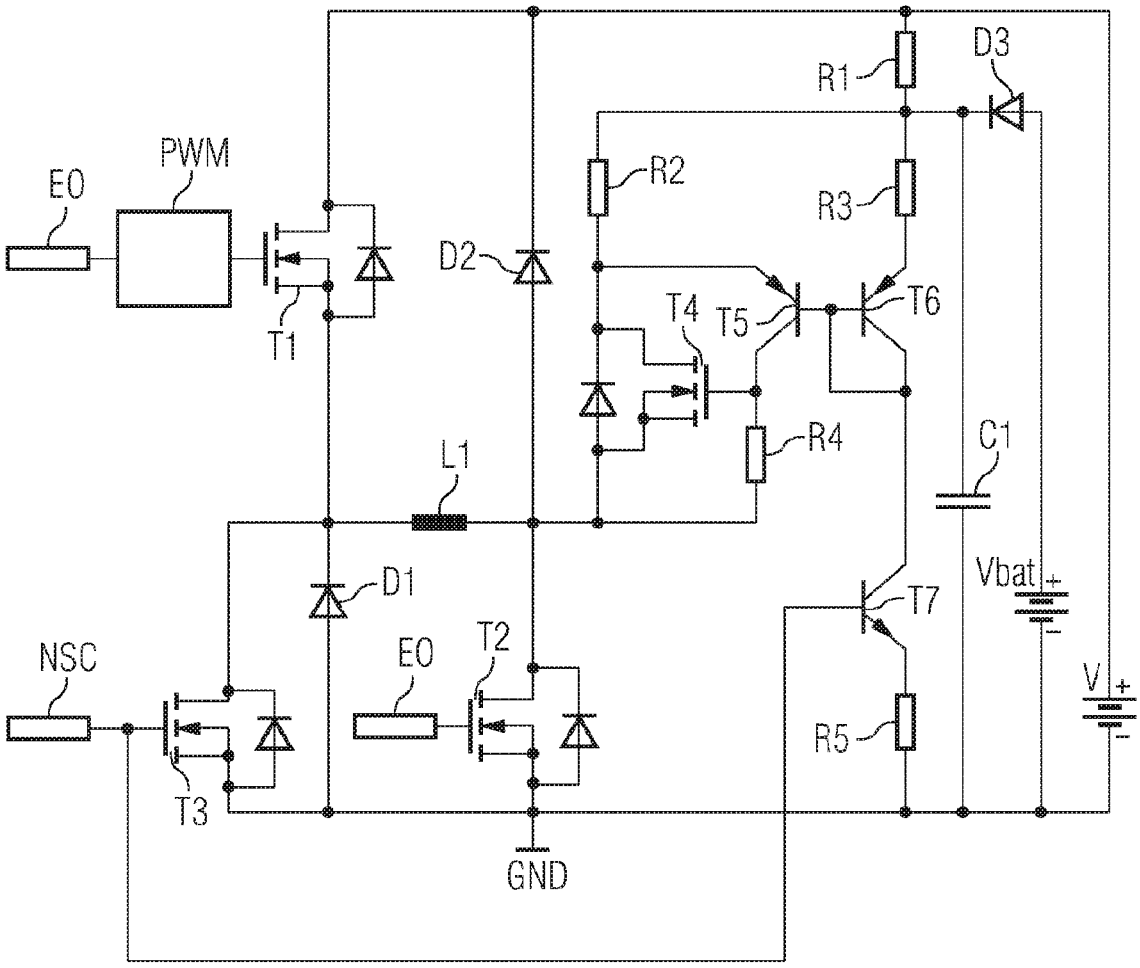
FIG. 4: shows an inventive circuit arrangement for PWM operation of an inductive fuel injection valve.

FIG. 4 shows an inventive circuit arrangement for PWM operation of a coil, for example the opening coil L1 of an inductive fuel injection valve. The circuit part (T1, T2, D1, D2) used for controlling the valve operating current has already been explained in the description relating to FIG. 1.

As described there, one terminal of the coil L1, for example the opening coil of the valve, is connected by means of the first switching transistor T1 to the positive pole V+ of the supply voltage source V and the other terminal is connected by means of the second switching transistor T2 to reference potential GND. The source terminal of the first switching transistor T1 is connected to one terminal of the coil L1, and its drain terminal to the positive pole V+. The source terminal of the second switching transistor T2 is connected to reference potential GND, and its drain terminal to the other terminal of the coil L1.

The freewheeling diode D1 is arranged to conduct current from reference potential GND to one terminal of the coil L1 and the recuperation diode D2 is arranged to conduct current from the other terminal of the coil L1 to the positive pole V+ of the supply voltage source.

In addition, the circuit has been extended by five transistors T3 to T7, five resistors R1 to R5, one capacitor C1 and one diode D3, as well as by the integration of the onboard voltage source Vbat present in the vehicle.

The third transistor T3 is connected in parallel with the freewheeling diode D1: its source terminal is connected to reference potential GND, and its drain terminal to the connecting point of freewheeling diode D1 and one terminal of the coil L1. Said transistor serves in the current-conducting state to connect the terminal of the coil L1 connected to the first switching transistor T1 to reference potential GND.

Figure 6:
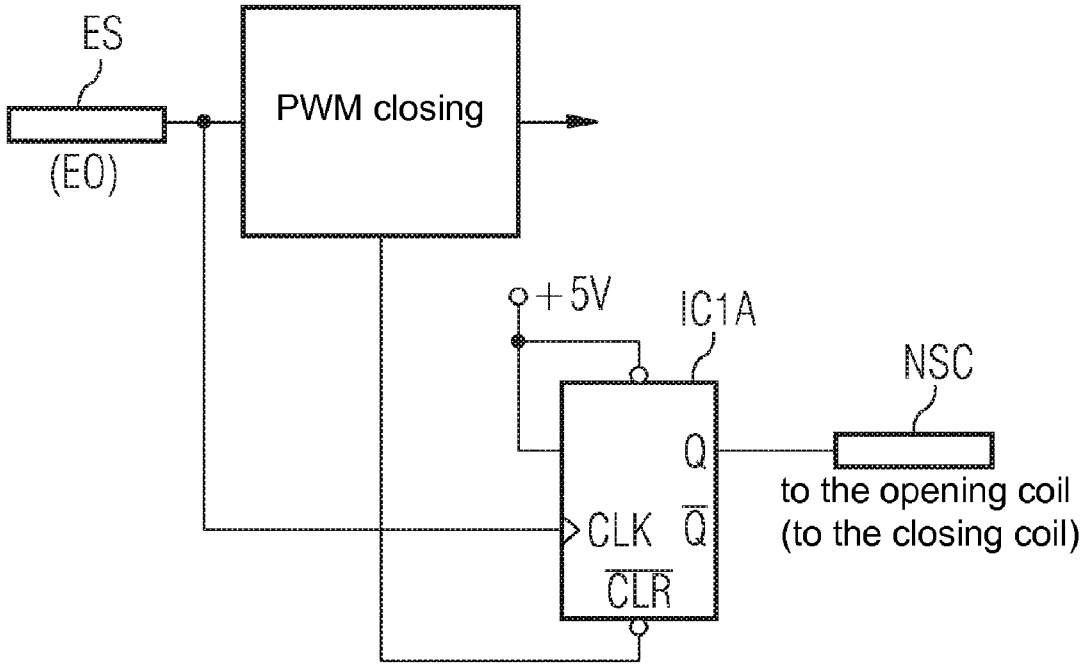
FIG. 6: shows a control device for the negative current in the case of a bistable fuel injection valve.
Figure 7:
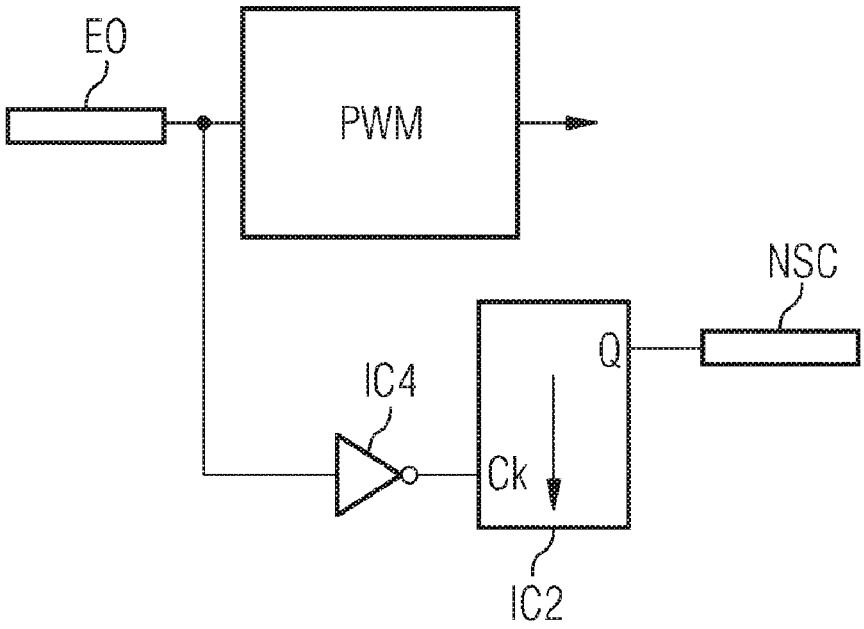
FIG. 7: shows a control device for the negative current in the case of a standard injection valve with opening coil and closing spring.

The transistors T4 to T6 together with the resistors R2 to R4 form a complementary Darlington current mirror which supplies a negative current. Said current mirror T4-T6 is connected via a first resistor R1 to the positive pole V+ of the supply voltage V. The source terminal of the fourth transistor T4 is connected to the other terminal of the coil L1, while the source terminal of the sixth transistor T6 is connected via the series circuit of the seventh transistor T7 and the fifth resistor R5 to reference potential GND. The gate terminals of the third transistor T3 and the seventh transistor T7 are connected to one another and to the output of a control device, which is shown in FIGS. 6 and 7, for the purpose of generating a negative current control signal NSC for the negative current.

Connected into the circuit between the terminal of the first resistor R1 connected to the current mirror T4-T6 and reference potential GND is a capacitor C1 which is charged up by the vehicle onboard voltage source Vbat via a protection diode D3 and supplies the current mirror T4-T6 with energy, said current mirror being controlled by the seventh transistor T7 which is connected as a current source.

As long as the control signal NSC has low level (0V) at the gate terminal of the third transistor T3, said transistor T3 and also the seventh transistor T7 are switched to the non-conducting state, with the result that no current flows at the output of the current mirror formed by the source terminal of the fourth transistors T4 either. The circuit is inactive; no current flows through the coil L1 in the negative direction (in the direction from transistor T4 to transistor T3).

If the control signal NSC jumps to high level (e.g. +5V), the third transistor T3 is switched to conducting and connects one terminal of the coil L1 to reference potential GND. Simultaneously, a current begins to flow through the seventh transistor T7, the magnitude of said current being determined by the value of the fifth resistor R5 and the base voltage (+5V) of the seventh transistor T7 minus its base-emitter voltage (5V−0.7V≈4.3V).

Furthermore, said current also flows through the sixth transistor T6 and the third resistor R3, at which transistors it generates a voltage drop. According to the principle of operation of a current mirror comprising emitter resistors (for negative current feedback), the same voltage drop will develop between the base terminal of the fifth transistor T5 and the second resistor R2. If the value of resistor R2 is now chosen to be substantially less than the value of R3, a correspondingly higher current through R3 is required for that purpose:

$$I_{R2}/I_{R3}=R3/R2$$

The fifth transistor T5 together with the fourth transistor T4 forms a complementary Darlington transistor. Accordingly, the major portion of the current $I_{R2}$ flowing through the second resistor R2 will flow through the fourth transistor T4.

No current flow is necessary for static control of the fourth transistor T4, which is embodied as a MOS FET; instead, a gate-source voltage corresponding to the drain current and the control characteristic must be set. If the value of the fourth resistor R4 is selected such that $I_{D(T4)}=I_{R2}$ (drain current through T4=current through the second resistor R2) the condition applies:

$$U_{GS(T4)}/R4=I_{R3},$$

where $U_{GS(T4)}$=gate-source voltage of the fourth transistor T4 and $I_{R3}$=current through the third resistor R3, then approximately identical currents flow through the two transistors T5 and T6. This improves the accuracy of the current transmission ratio $I_{R2}/I_{R3}$ in the current mirror to such an extent that even large transmissions of, for example, >1000:1 can be represented stably and reproducibly. In the illustrated example, an output current of 2 A through transistor T4 is controlled by means of a control current of, for example, 2 mA through transistor T7. The current mirror is supplied from the capacitor C1.

At the beginning of a negative current pulse initiated by the signal NSC, capacitor C1 is charged up by means of the first resistor R1 to the potential of the supply voltage V+ (e.g. +48V). In this case a current through the opening or closing coil in the opposite direction to the direction of the actuation current is defined as the negative current.

The value of R1 is chosen here as high enough so that its current flow is substantially less than the negative current flowing through the second resistor R2 and the fourth transistor T4. The value of R1 must nonetheless be small enough to permit a charging-up of the capacitor C1 to the potential V+ in the intervals between two successive negative current pulses.

Capacitor C1 is now discharged by the (negative) current flowing through the second resistor R2 and the fourth transistor T4 through the coil L1 and the third transistor T3 and its voltage becomes less than the vehicle onboard voltage Vbat. This causes the protection diode D3 to become conducting and capacitor C1 to be clamped to the vehicle onboard voltage Vbat. What is achieved thereby is that at the beginning of a negative current pulse the high supply voltage V+ enables a fast current buildup in the coil L1 and subsequently is low enough so as not to allow any unnecessary power dissipation to occur in the fourth transistor T4.

Figure 5A:
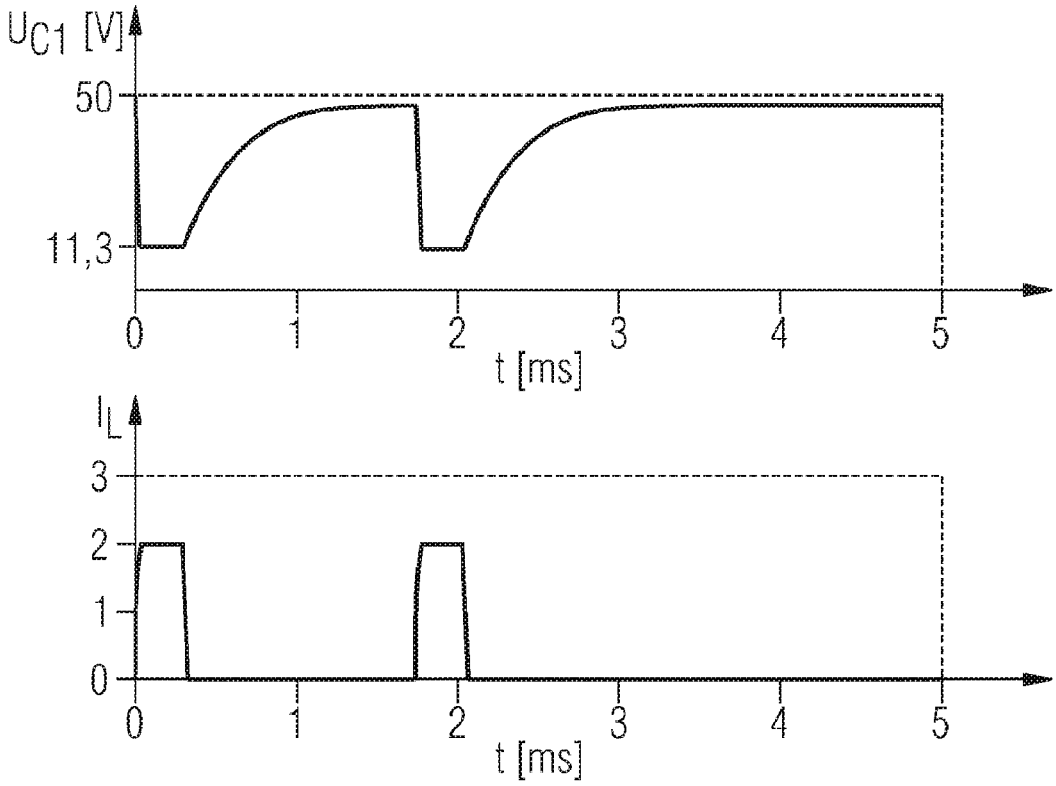
FIG. 5*a*: shows voltage and current profile at the current mirror of the inventive circuit arrangement.

FIG. 5*a* shows the voltage and current profiles at the current mirror T4-T6, the upper track showing the voltage $U_{C1}$ at the capacitor C1. As the negative current pulse $I_{L1}$ grows, the voltage $U_{C1}$ drops until it is clamped at approx. 11.3V. Following termination of the negative current pulse the voltage $U_{C1}$ increases once again to V+. The lower track shows the negative current pulse $I_{L1}$. The setpoint value of 2 A is reached already after 38 μs.

In the case of bistable valves it has been shown that the duration of the negative current pulse should be set to the time period that the current in the other coil needs to reach its operating value. This enables the control signal NSC to be obtained in a simple manner. All that is required is a flip-flop which can be set at the start of the valve activation and reset in turn when the operating current is reached for the first time.

FIG. 6 shows a circuit of such a control device in the case of a bistable valve for the negative current through one coil, for example the opening coil L1, by means of the closing signal of the other coil, for example the closing coil.

Said circuit consists solely of a flip-flop IC1A. The flip-flop IC1A (terminal CLK) is set by means of the rising edge e.g. of the closing signal ES for the closing coil (not shown), such that the flip-flop's output Q, at which the signal NSC appears, assumes high level.

Figure 2:
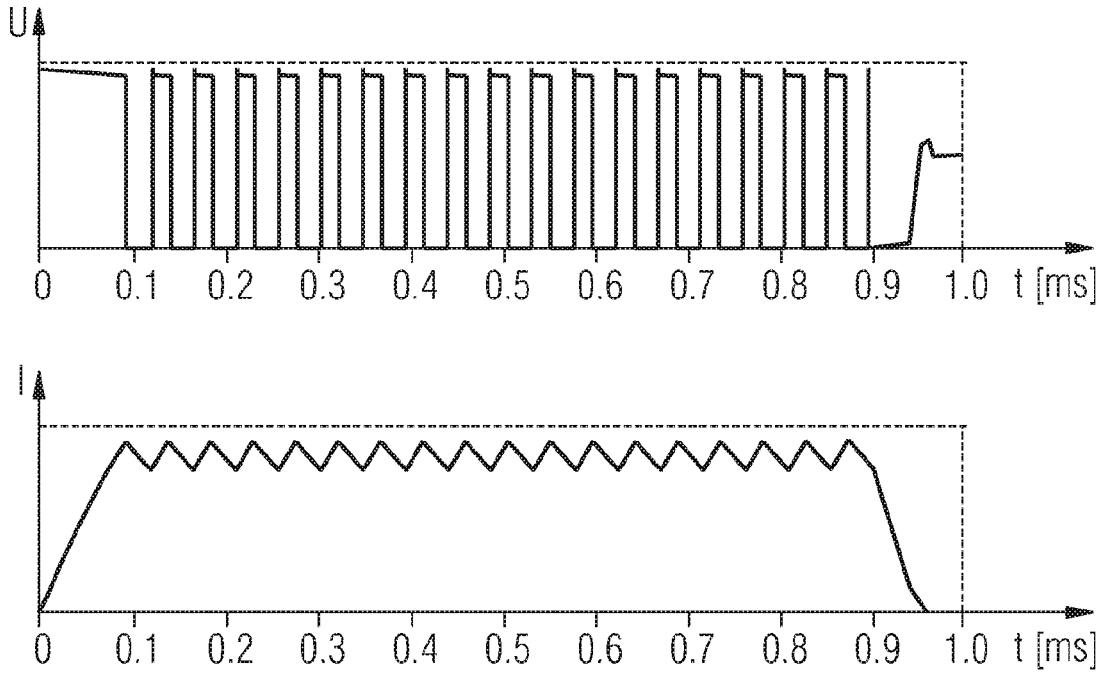
FIG. 2: shows the voltage and current profiles during PWM operation of the fuel injection valve according to FIG. 1, FIG. 3: shows a detail view of a bistable fuel injection valve.
Figure 3:
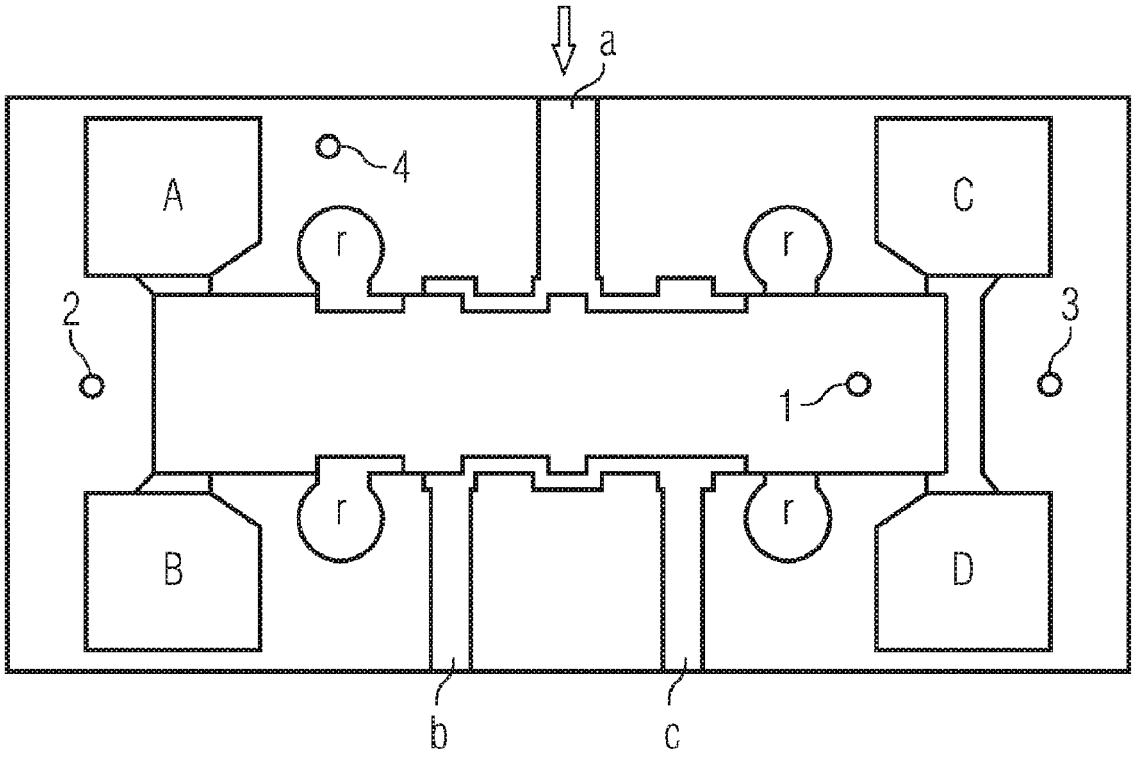

At this point in time the output of the PWM unit PWM (see FIGS. 2 and 4) connected to terminal CLR-Not of the flip-flop IC1A receives high level. If the current through the closing coil reaches its operating value, said output switches to low level and consequently also clears the flip-flop IC1A, with the result that the latter's output signal NSC at the output Q returns to low level. Thus, the signal NSC supplied to the base terminal of the transistors T3 and T7 of the circuit for the opening coil L1 has high level for as long as the current through the closing coil needs until it reaches its operating value for the first time.

Figure 5B:
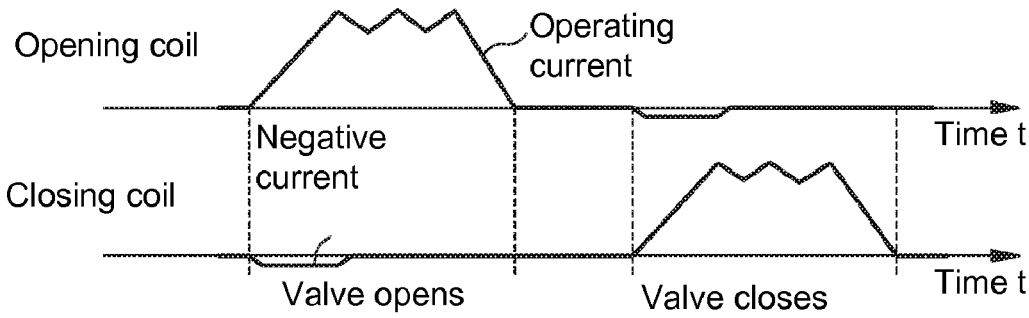
FIG. 5*b*: shows the time characteristic of operating current and negative current during the opening and closing of a bistable valve.

For a bistable valve, a circuit according to FIG. 4 and FIG. 6 is required both for the opening and for the closing coil in order to generate the negative current. It is important to note that the appropriate PWM unit for opening the valve controls the negative current pulse in the closing coil of the valve and the appropriate PWM unit for closing the valve controls the negative current pulse in the opening coil of the valve. The time characteristic of operating current and negative current for opening and closing a bistable valve is represented schematically in FIG. 5*b*.

For a standard valve with opening coil and closing spring, the negative current of the single coil L1 must be controlled at the end of the opening signal EO, as shown in FIG. 7.

In the case of the control unit according to FIG. 7, the negative current serves to quench the eddy currents which still continue to flow in the magnetic circuit of the standard valve after the turning-off and decaying of the current in the opening coil. Toward that end, a negative current should be conducted through the opening coil L1 immediately after termination of the valve activation (falling edge of the actuation (opening) signal EO. For that purpose the circuit according to FIG. 7 includes a timing element (monoflop IC2) for determining the duration of the negative current pulse through the coil L1, which timing element is triggered by means of a falling edge of the signal EO inverted by means of an inverter IC4.

Only one circuit according to FIG. 4 and FIG. 7 is required in each case for a standard valve.

In a further advantageous embodiment of the circuit according to FIG. 4, diode D1 can be omitted, in which case the substrate diode of transistor T3 takes over its function, i.e. freewheeling.

The advantages of the inventive circuit according to FIG. 4 are as follows:

- a time-variable supply voltage is produced, as a result of which the power dissipation in the current source can be kept low;
- the Darlington current mirror is supplied from a capacitor which is initially charged up to the potential of the supply voltage V+ in order to achieve a rapid current increase in the coil inductance.

For bistable valves having two actuation windings, the negative current is controlled by means of a signal from the drive electronics which controls the current profile in the opposite coil in each case.

For standard valves with closing spring, the negative current is controlled by means of the falling edge of the actuation (opening) signal.

In the further course of the negative current the capacitor voltage is clamped to the vehicle onboard voltage Vbat.

In a further advantageous exemplary embodiment, the energy required for the demagnetization can also be applied in an accelerated manner. This is beneficial when the fastest possible start of the valve movement is required. For this purpose the negative current is specified not by means of a predefined, largely constant value for a specific time period, as FIG. 5*a* shows, but as an approximately triangular current pulse with predefined maximum value (FIG. 9*b*).

The speed of the current rise is therein determined by the inductance of the coil and the supply voltage V. The peak value of the current is also higher than in the case of the first embodiment variant, since the demagnetization energy is produced in a shorter time.

Figure 9A:
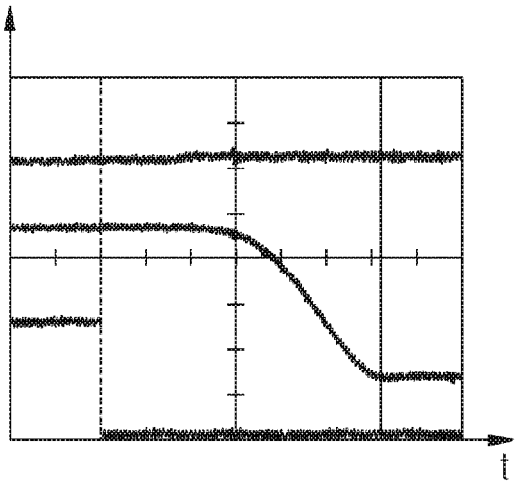
FIG. 9: shows the time characteristic of the valve switching movements, without (9*a*) and with demagnetization current (9*b*)
Figure 9B:
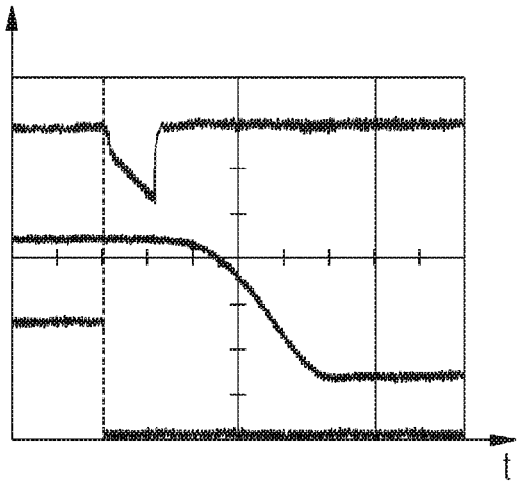

In FIG. 9 the valve switching times without (FIG. 9*a*) and with demagnetization current (FIG. 9*b*) are compared with one another. In the figure the top track: shows the demagnetization current, the middle track: shows the valve movement, and the bottom track: shows the control signal (falling edge).

Figure 10:
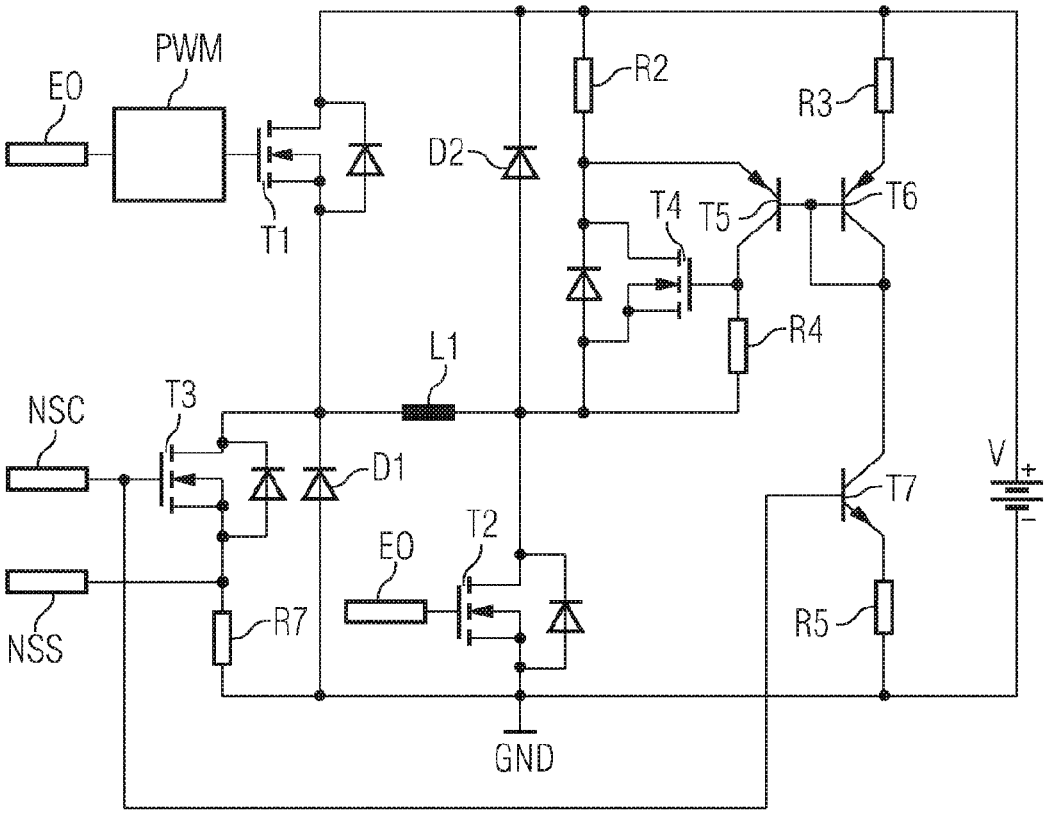
FIG. 10: shows a further circuit arrangement.

A circuit diagram for a circuit arrangement of this kind is shown in FIG. 10. The circuit essentially corresponds to the embodiment according to FIG. 4, except that resistor R1, capacitor C1, diode D3, and the connection to the vehicle onboard voltage source Vbat are omitted. Also, the resistors R2 and R3 are connected directly to the positive pole V+ of the supply voltage and a resistor R7 is inserted between the source terminal of transistor T3 and the ground terminal GND.

In addition, the current source T4-T6 is now configured for a substantially higher constant current—for example 8 A—by the choice of the value ratio of the resistors R2 and R3.

When the negative current control signal NSC is activated by means of the closing signal, the transistor T3 assigned to the opening coil is switched—as described with reference to FIG. 4—to the conducting state, and simultaneously the current source T4 to T6 by means of transistor T7. According to the inductance of the coil L1 (opening coil), the current through it will now rise over time (FIG. 9*b*, top track). Said current can be observed as the negative current sense voltage NSS at the resistor R7. Once said voltage NSS has reached a predefined value, the negative current control signal NSC is switched to 0V, thereby terminating the current flow.

The valve switching time determined in a measured exemplary embodiment of the circuit according to FIG. 10 is shortened for example from 620 μs (without demagnetization current, FIG. 9*a*) to 504 μs (with demagnetization current, FIG. 9*b*). The current source T4-6 also possesses a protection function, since the current from T6 will be limited in the event of a shorting of the right-hand terminal of the coil L1 to reference potential.

The valve coils are located in the injection valve (not shown) on the engine block of the internal combustion engine outside the electronic control device, and a shorting of the feed lines to vehicle ground is a common fault. This must not, however, result in damage to the electronics.

Figure 11:
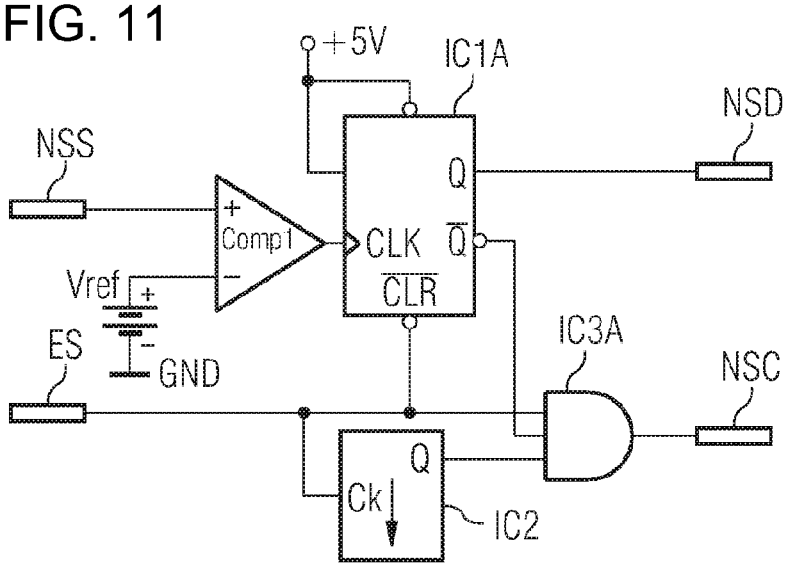
FIG. 11: shows a control unit for the circuit arrangement according to FIG. 10, FIG. 12: shows the signal shapes in said control unit.

The negative current sense voltage NSS is evaluated and the negative current control signal NSC is controlled by means of a suitable control unit, which is described in FIG. 11.

The control unit according to FIG. 11 implemented for a bistable injection valve contains a monoflop IC2, a flip-flop IC1A, a comparator Comp1, and an AND element IC3A having three inputs. The closing signal ES is connected to the trigger input Ck of the monoflop IC2, to an input of the AND element IC3A and to the reset input CLR-Not of the flip-flop IC1A.

The signal NSS (negative current sense) tapped at the resistor R7 in FIG. 10 is connected to the non-inverting input of the comparator Comp1, to the inverting input of which a reference voltage Vref is supplied. The output of the comparator Comp1 is connected to the trigger input CLK of the flip-flop IC1A.

The output Q of the monoflop IC2 is connected to a second input of the AND element, whose third input is connected to the inverting output Q-Not of the flip-flop IC1A.

The signal NSC (negative current control) appears at the output of the AND element IC3A, and a signal NSD (negative current diagnosis) appears at the non-inverting output Q of the flip-flop IC1A.

The control signal already described in FIG. 6, the closing signal ES for example, controls the turning-on of the negative current for the opening coil L1 in this case also. However, the negative current is now turned off when a predefined current value is reached, though this current value must be smaller than the setpoint value of the current of the current source T4-6.

Figure 12:
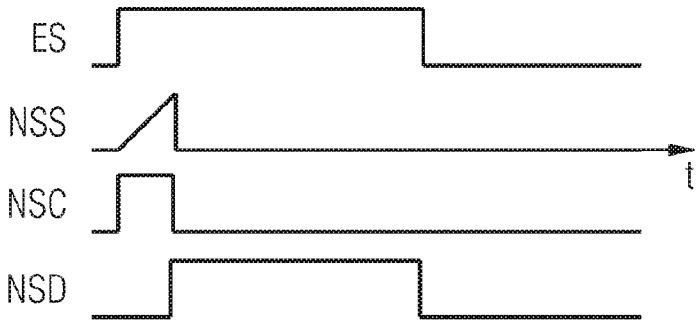

The signal profiles of the control unit shown in FIG. 11 are presented in FIG. 12. At the beginning let the closing signal ES have low level. This level is also present at the reset input CLR-Not of the flip-flop IC1A, with the result that a negative current diagnosis signal NSD with low level is present at its non-inverting output Q. Corresponding thereto, the inverting output Q-Not of flip-flop IC1A has high level.

The rising edge of the control signal ES clocks the monoflop IC2, whose output Q now assumes high level for the duration of the monoflop time. The AND element IC3A combines the signals ES, Q of IC2 and Q-Not von IC1A. Since all these signals now have high level, the signal NSC at the output of AND element IC3A likewise assumes high level by means of the rising edge of the control signal ES. The negative current begins to increase.

As a result the transistors T3 and T4 (FIGS. 9*b* and 10) become conductive, so that a current starts to flow through the coil L1 (FIG. 10). Said current also flows through resistor R7, a corresponding voltage drop, negative current sense signal NSS, being produced. Comparator Comp1 now compares this voltage NSS with the reference voltage Vref.

If NSS<Vref, then the output of the comparator Comp1 has low level. If the value of NSS exceeds the value of Vref, the output of the comparator Comp1 jumps to high level and sets the downstream flip-flop IC1A. The latter's inverting output Q-Not jumps to low level and switches the signal NSC to low level via the AND element IC3A, thereby causing the negative current in the opening coil L1 to be turned off. Similarly, the signal NSD at the non-inverting output Q jumps to high level.

A potential malfunction can be detected by observation of the instant in time at which said voltage jump occurs or of whether it occurs. The type of fault can also be detected. If there is a shorting to reference potential in one of the feed lines of the coils, no current will flow through resistor R7 and the signal NSD remains at low level. This also applies in the case of a line break.

It is therefore sufficient to interrogate the signal NSD 3 immediately before the opening signal EO or closing signal ES is turned on.

The time constant of the monoflop IC2 is chosen such that the desired value of the negative current is reliably reached, yet a thermal overloading of the power transistor T4 of the current source is avoided in the event of shorting to reference potential.

If the signal NSS (negative current sense) has not exceeded the value of Vref before the time constant has expired, the downstream flip-flop IC1A will not be triggered. The signal NSD at the non-inverting output Q remains at low level. The output Q of the monoflop IC2 goes to low level again and blocks the AND element IC3A, with the result that the latter's output signal NSC goes to low level.

In the case of a bistable valve, a circuit according to FIG. 10 and FIG. 11 is required again in each case for the opening coil and for the closing coil.

Figure 13:
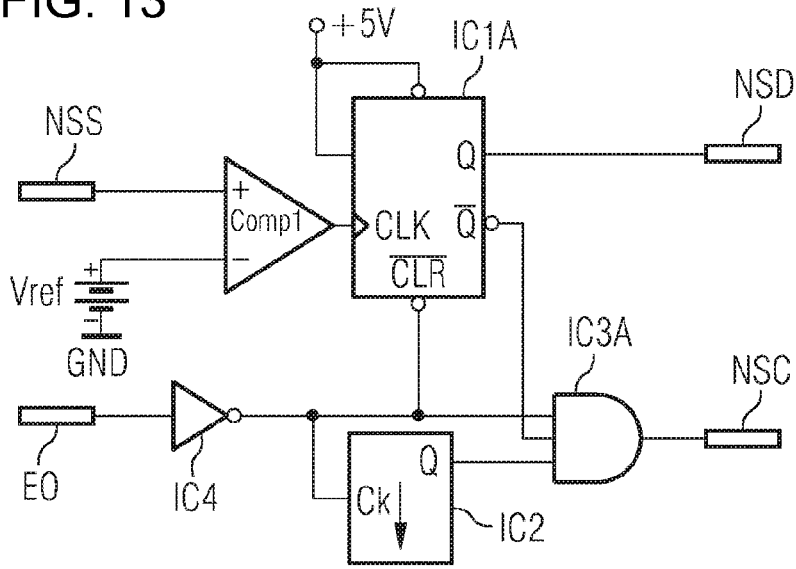
FIG. 13: shows a control unit for the circuit arrangement according to FIG. 10, FIG. 14: is a schematic representation of a standard solenoid injection valve.

For a standard valve with closing spring, the control unit of which is shown in FIG. 13, the control unit according to FIG. 11 is supplemented to the extent that the opening signal EO, before being supplied to the monoflop IC2, the AND element IC3A and the flip-flop IC1A, is inverted by means of an inverter IC4, with the result that the monoflop IC2 is triggered only by the falling edge of the signal EO.

Figure 8:
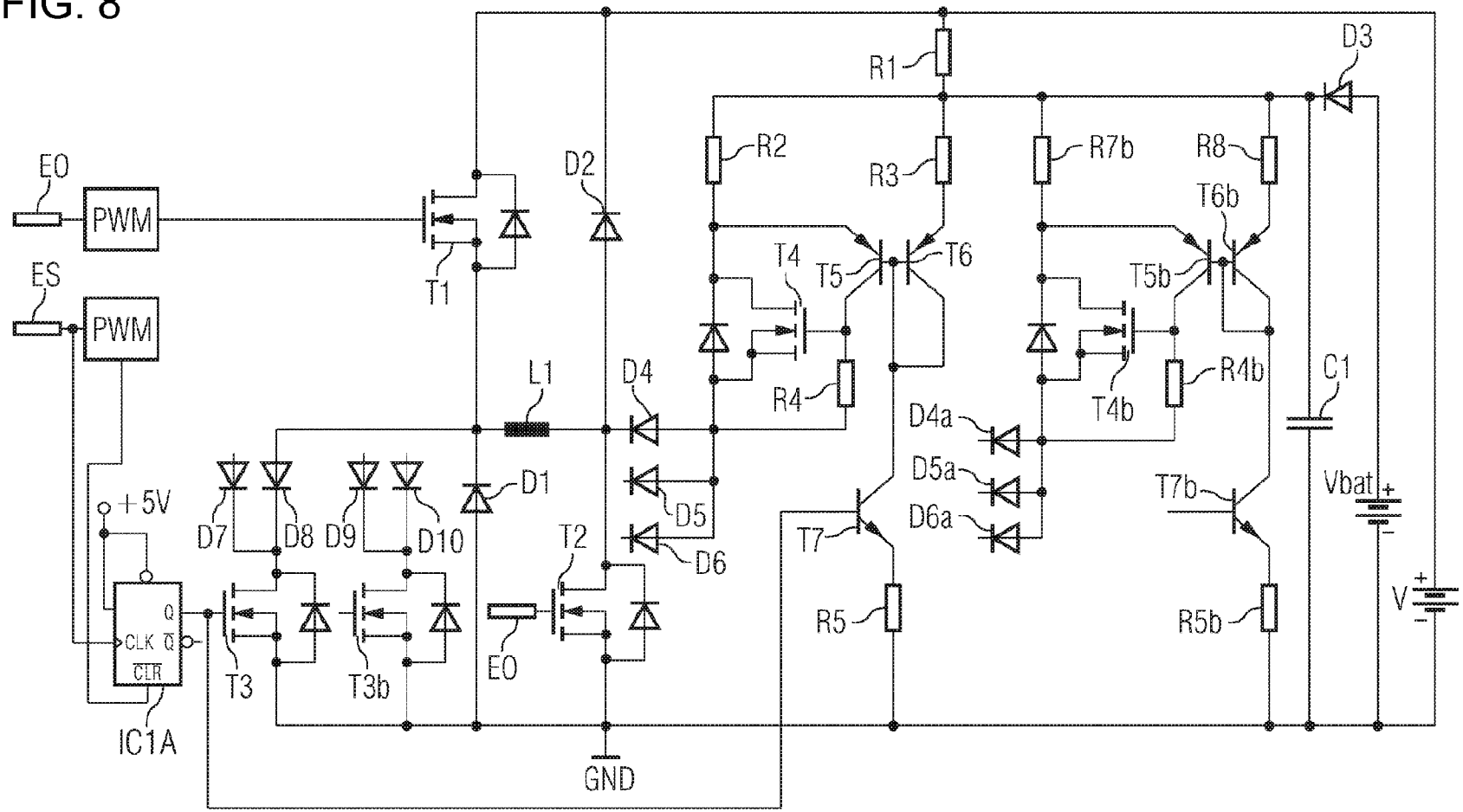
FIG. 8: shows an inventive circuit arrangement for operation of a plurality of valve coils.

As shown in FIG. 8 for a circuit arrangement according to FIG. 4, in a further advantageous embodiment according to the invention, the circuit arrangement according to FIG. 4 or FIG. 10 can be expanded for the purpose of actuating a plurality of valves, i.e. all (for example four or six) fuel injection valves of an internal combustion engine without the need to increase the number of circuits proportionally. This can be achieved by the addition of additional diodes D7 to D10 in series with the drain terminal of the third transistor T3, additional diodes D4*a* to D6*a* and D4*b* to D6*b* in series with the source terminal of the transistor T4, and/or a further transistor T3*b* or a further current mirror T4*b*-T7*b*, R2*b*-R5*b*.

For this purpose, however, an additional selection circuit (not shown) is required which selects the current path desired in each case by suitable control of T3, T3*b*, T7, T7*b*.

The main obstacle during closing are, as already explained, the eddy currents in the magnetic material of the valve, which decay slowly after the actuation current is turned off and prevent fast closing of the valve. For this reason steel with low electric conductance is generally used.

In order to reduce the closing delay in the case of standard solenoid valves even further, according to the invention, in addition to the use of a negative current pulse, use is also made of the different decay times of eddy currents in magnetic materials having different electric conductances.

Figure 14:
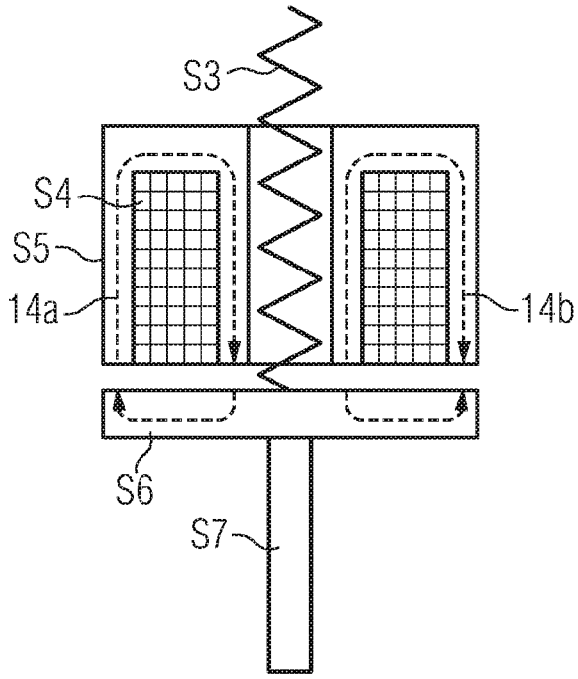

FIG. 14 shows a schematic representation of a standard solenoid injection valve with coil S4 and closing spring S3. The coil S4 is enclosed by the magnetic yoke S5. The valve needle S7 and the armature S6 connected thereto is pressed against a valve seat (not shown) by the closing spring S3 and thereby closes the valve opening (not shown). When the coil S4 is excited, the armature S6 is attracted against the force of the closing spring S3 and the valve thereby opened.

For that purpose, contrary to the above-described rule, according to the invention a material having the highest possible conductance is chosen for the armature S6 in order to allow the eddy currents to decay as slowly as possible in the armature. The magnetic yoke S5, on the other hand, consists as in the prior art of material having low electric conductance.

In this way it is possible, during the closing of the valve through application of a negative current pulse to the coil S4 to temporarily achieve a field reversal in the magnetic yoke S5 while the original exciter field in the armature S6 has not yet completely decayed.

This temporarily results in a repulsive force between magnetic yoke S5 and magnetic armature S6 in the gap between magnetic yoke and magnetic armature, which significantly accelerates the commencement of the closing movement and the closing cycle of the valve.

FIG. 14 shows the unbroken field lines 14*a* (on the left) with the valve open and the dashed field lines 14*b* (on the right) in the closing cycle during the temporarily induced field reversal.

Figure 15:
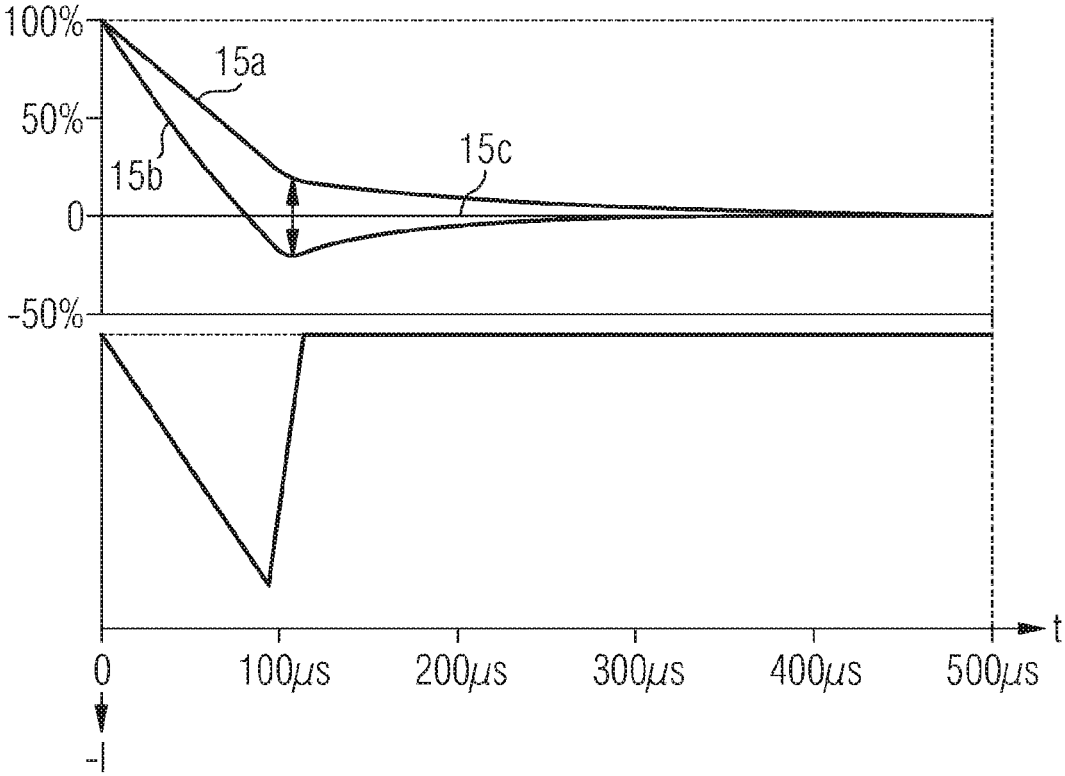
FIG. 15: shows the generation of transitory, opposite field directions.

FIG. 15 shows in schematic form the generation of temporary opposite field directions between magnetic yoke S5 and armature S6.

The bottom diagram shows the time characteristic of the negative current pulse applied to the coil during the closing cycle of the injection valve.

The field strengths or holding forces generated due to eddy currents are shown in the top diagram. The respective value of the eddy current is assigned a magnetic field strength and hence a holding force.

The top curve 15*a* shows the profile of the field strength effective in the armature S6—which consists of material having the highest possible electric conductance—while the bottom curve 15*b* shows the profile of the field strength effective in the magnetic yoke S5—which is made of material having low electric conductance.

Also shown is the line 15*c*, which represents the holding force of the closing spring S3.

At the instant in which the field strength influenced by the negative current pulse—curve 15*b*—becomes negative and so reverses its direction, the repulsive force between magnetic yoke S5 and armature S6 begins to take effect. This force is at its greatest at the point marked by a double arrow.

The combination of negative current pulse at the end of the exciter current and suitable choice of the magnetic material properties therefore produces overall a substantial reduction in the turn-off delay in the case of standard solenoid valves.

The invention claimed is:

1. A device for switching a inductive fuel injection valves, wherein, in the case of a bistable fuel injection valve having an opening and closing coil, the magnetic holding forces induced by remanence which hold a valve needle firmly in a closed position are eliminated by way of a negative current generated in the closing coil in order to accelerate the opening of the valve, and which hold the valve needle firmly in the open position are eliminated by way of a negative current generated in the opening coil in order to accelerate the closing of the valve; and wherein, in the case of a standard fuel injection valve having an opening coil and a closing spring, eddy currents in the magnetic material of the opening coil that are induced after the actuation signal has been turned off and decay only slowly are eliminated by way of a negative current generated in the opening coil;

wherein a current through the opening or closing coil in the opposite direction to the direction of the actuation current is defined as the negative current;

the device comprising:

a circuit configuration with a coil of a fuel injection valve, said coil being controlled by a switching signal via a pulse width modulation unit;

said coil having a first terminal connected to a positive pole of a supply voltage source by way of a first switching transistor and a second terminal connected to reference potential by way of a second switching transistor;

said first switching transistor having a source terminal connected to said first terminal of said coil, a drain terminal connected to the positive pole of the supply voltage source, and a gate terminal connected to an output of said pulse width modulation unit;

said second switching transistor having a source terminal connected to reference potential and a drain terminal connected to said second terminal of said coil;

a freewheeling diode connected to conduct current from the reference potential to one terminal of said coil and a recuperation diode connected to conduct current from the other terminal of said coil to the positive pole of the supply voltage source;

a third transistor connected in parallel with said freewheeling diode, said third transistor having a source terminal connected to reference potential and a drain terminal connected to a connection node between said freewheeling diode and one terminal of the coil;

a complementary Darlington current mirror connected to the positive pole of the supply voltage source via a first resistor;

said current mirror including a fourth transistor with a source terminal connected to said second terminal of said coil, and a sixth transistor with a source terminal connected to reference potential via a series circuit formed of a seventh transistor and a fifth resistor;

said third transistor and said seventh transistor having gate terminals connected to one another and connected such that a negative current control signal may be supplied thereto;

a capacitor connected in parallel with said a series circuit formed of said sixth transistor, said seventh transistor, and said fifth resistor; and a further series circuit connected in parallel with said capacitor, said further series circuit including a vehicle onboard voltage source connected to reference potential on one side and a protection diode conducting current toward said capacitor.

2. The device according to claim 1, wherein the fuel injection valve is a bistable fuel injection valve and the device further comprises a control device for generating a negative current control signal, said control device having a flip-flop to be set by the opening or closing signal of the opening or closing coil and to be reset by the closing signal of said pulse-width-modulation unit assigned to said coil, wherein between the setting and resetting of said flip-flop, the negative current control signal appears at a non-inverting output and is supplied to a circuit configuration of the respectively other coil in each case.

3. The device according to claim 2, wherein the control device is provided for opening and closing the coil of the bistable fuel injection valve.

4. The device according to claim 1 configured for a standard fuel injection valve wherein said control device is provided for generating a negative current control signal, said control device having a series circuit of an inverter and a monoflop, wherein an opening or closing signal inverted by said inverter sets said monoflop, at whose non-inverting output the negative current control signal appears during the holding time of the monoflop and is supplied to the circuit configuration of the respectively other coil in each case.

5. The device according to claim 4, wherein the control device is provided for the purpose of controlling the standard fuel injection valve.

6. A device for switching inductive fuel injection valves, wherein, in the case of a bistable fuel injection valve having an opening and closing coil, the magnetic holding forces induced by remanence which hold a valve needle firmly in a closed position are eliminated by way of a negative current generated in the closing coil in order to accelerate the opening of the valve, and which hold the valve needle firmly in the open position are eliminated by way of a negative current generated in the opening coil in order to accelerate the closing of the valve; and wherein, in the case of a standard fuel injection valve having an opening coil and a closing spring, eddy currents in the magnetic material of the opening coil that are induced after the actuation signal has been turned off and decay only slowly are eliminated by way of a negative current generated in the opening coil;

wherein a current through the opening or closing coil in the opposite direction to the direction of the actuation current is defined as the negative current;

the device comprising:

a circuit configuration with a coil of a fuel injection valve, said coil being controlled by a switching signal via a pulse width modulation unit;

said coil having a first terminal connected to a positive pole of a supply voltage source by way of a first switching transistor and a second terminal connected to reference potential by way of a second switching transistor;

said first switching transistor having a source terminal connected to said first terminal of said coil, a drain terminal connected to the positive pole of the supply voltage source, and a gate terminal connected to an output of said pulse width modulation unit;

said second switching transistor having a source terminal connected to reference potential and a drain terminal connected to said second terminal of said coil;

a freewheeling diode connected to conduct current from the reference potential to one terminal of said coil and a recuperation diode connected to conduct current from the other terminal of said coil to the positive pole of the supply voltage source;

a third transistor connected in parallel with said freewheeling diode, said third transistor having a source terminal connected to reference potential via a seventh resistor and a drain terminal connected to a connection node between said freewheeling diode and one terminal of said coil;

a complementary Darlington current mirror having a fourth transistor, a sixth transistor, a second resistor and a fourth resistor;

said fourth transistor having a source terminal connected to said second terminal of said coil, said sixth transistor having a source terminal connected to reference potential via a series circuit of a seventh transistor and a fifth resistor, and drain terminals of said fourth and sixth transistors being connected to the positive pole of the supply voltage source via a resistor;

said third transistor and said seventh transistor having gate terminals connected to one another and connected such that a negative current control signal can be supplied thereto; and said seventh resistor carrying a negative current sense signal to be tapped thereat.

7. The device according to claim 6, wherein the fuel injection valve is a bistable fuel injection valve and a control device is provided for the purpose of generating the negative current control signal, said control device containing a comparator with a non-inverting input receiving the negative current sense signal and an inverting input receiving a reference voltage;

a flip-flop having a set input connected to an output of said comparator and a non-inverting output carrying a negative current diagnosis signal;

a monoflop and an AND element having three inputs and an output, wherein the closing signal or the opening signal can be supplied to a first input of said AND element, the trigger input of said monoflop, and the reset input of said flip-flop, a second input of said AND element is connected to said inverting output of said flip-flop; and a third input of said AND element is connected to the output of said monoflop, and said output of said AND element carrying the negative current control signal.

8. The device according to claim 6, wherein the fuel injection valve is a standard fuel injection valve and the control device according to claim 6 is configured to generate the negative current control signal, and which further comprises an inverter for inverting the closing signal before the closing signal is supplied to an input of an AND element, a trigger input of said monoflop, and a reset input of said flip-flop.

9. The device according to claim 8, wherein:

if the negative current flowing through the opening or closing coil:

does not reach a predefined value before the monoflop holding time expires: or a shorting to reference potential or a line break occurs in one of the feed lines to the coils;

then:

the negative current diagnosis signal of said opening coil has low level prior to the turning-on of the opening signal; or the negative current diagnosis signal of the closing coil has low level prior to the turning-on of the closing signal.

10. The device according to claim 7, wherein:

if the negative current flowing through the opening or closing coil:

does not reach a predefined value before the monoflop holding time expires: or a shorting to reference potential or a line break occurs in one of the feed lines to the coils;

then:

the negative current diagnosis signal of said opening coil has low level prior to the turning-on of the opening signal; or the negative current diagnosis signal of the closing coil has low level prior to the turning-on of the closing signal.

11. The device according to claims 1, wherein the fuel injection valve is a standard fuel injection valve, and a magnetic yoke of said coil and an armature are manufactured from materials having mutually different electric conductances.

12. The device according to claim 11, wherein the armature consists of material having a highest possible electric conductance and the magnetic yoke consists of material having a low electric conductance.

13. The device according to claims 6, wherein the fuel injection valve is a standard fuel injection valve, and a magnetic yoke of said coil and an armature are manufactured from materials having mutually different electric conductances.

14. The device according to claim 13, wherein the armature consists of material having a highest possible electric conductance and the magnetic yoke consists of material having a low electric conductance.

* * * * *